US007881425B2

(12) United States Patent
Vermilyea et al.

(10) Patent No.: US 7,881,425 B2
(45) Date of Patent: Feb. 1, 2011

(54) WIDE-COVERAGE X-RAY SOURCE WITH DUAL-SIDED TARGET

(75) Inventors: Mark E Vermilyea, Niskayuna, NY (US); James E Simpson, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 73 days.

(21) Appl. No.: 12/317,908

(22) Filed: Dec. 30, 2008

(65) Prior Publication Data

US 2010/0166141 A1 Jul. 1, 2010

(51) Int. Cl.
*H05G 1/60* (2006.01)
*H01J 35/06* (2006.01)
*H01J 35/00* (2006.01)

(52) U.S. Cl. ..... 378/19; 378/134; 378/132

(58) Field of Classification Search ..... 378/124, 378/134, 136, 143, 144, 4, 19
See application file for complete search history.

(56) References Cited

U.S. PATENT DOCUMENTS

| | | | | |
|---|---|---|---|---|
| 6,125,167 | A | 9/2000 | Morgan | |
| 7,003,077 | B2 | 2/2006 | Jen et al. | |
| 7,065,179 | B2 | 6/2006 | Block et al. | |
| 7,120,222 | B2 * | 10/2006 | Hoffman | 378/5 |

FOREIGN PATENT DOCUMENTS

| | | |
|---|---|---|
| GB | 2333681 | 7/1999 |
| WO | 2008/122970 A1 | 10/2008 |

* cited by examiner

*Primary Examiner*—Irakli Kiknadze
(74) *Attorney, Agent, or Firm*—Jason K. Klindtworth

(57) ABSTRACT

An x-ray source is disclosed comprising: an anode disk with first and second beveled annuli at a periphery of the anode disk, the anode disk rotatably coupled to a housing structure via a support shaft; first and second cathodes mounted to a yoke support structure, the yoke support structure configured to direct cathode emissions at x-ray generating material disposed on the beveled annuli; and a high-voltage insulator configured to electrically insulate the yoke support structure from the housing structure.

19 Claims, 7 Drawing Sheets

WIDE-COVERAGE X-RAY SOURCE WITH DUAL-SIDED TARGET

BACKGROUND OF THE INVENTION

The subject matter disclosed herein relates to computed tomography systems and, in particular, to x-ray sources for such systems.

Future Computed Tomography (CT) medical imaging systems will be designed to perform volumetric, "organ-in-a-rotation" scanning. This requirement imposes significant increases in temporal resolution and axial coverage. In turn, this necessitates that the component x-ray tube produce x-rays that cover an increased axial extent with uniform intensity and that the tube be able to withstand mechanical stresses incurred as a result of faster gantry rotation speeds in the CT medical imaging (hereinafter scanning) systems.

CT imaging involves computer-aided reconstruction of an image internal to an object or a human patient, where the reconstructed image is generated from a plurality of views taken at a succession of different scan angles as the gantry rotates around the object or the patient. In an ideal scanning procedure, the plurality of views would lie in a single plane. However, as multi-slice scanning systems have become the industry norm, and the detector used in scanning systems is, accordingly, a component disposed in a distributed configuration along the axis of rotation, image reconstruction requires the processing of non-planar views. Reconstructed images are normally acceptable for an axial coverage of up to about 40 mm (i.e., the extent of the imaged area). However, for larger axial coverage, unacceptable levels of image artifacts are created when a single x-ray source is used in the scanning system. This problem is addressed in the present state of the art by providing multiple x-ray source locations along the rotation axis to increase axial coverage.

This is an emerging paradigm in CT systems for multi-spot systems. For example, U.S. Pat. No. 6,125,167 "Rotating anode x-ray tube with multiple simultaneously emitting focal spots" discloses an x-ray tube comprising a plurality of anode elements. A corresponding plurality of cathode assemblies function to generate a series of parallel x-ray beams.

The inventors herein have recognized a need for an x-ray source producing an x-ray beam that covers a target axial extent with substantially uniform intensity.

BRIEF DESCRIPTION OF THE INVENTION

An x-ray source comprising: an anode disk including a first beveled annulus and a second beveled annulus at a periphery of the anode disk, the anode disk rotatably coupled to a housing structure via a support shaft; a first cathode mechanically coupled to a yoke support structure, the yoke support structure configured to direct first cathode emissions at a first x-ray generating material disposed on the first beveled annulus; a second cathode mechanically coupled to the yoke support structure, the yoke support structure further configured to direct second cathode emissions at a second x-ray generating material disposed on the second beveled annulus; and a single high-voltage insulator configured to mechanically attach the yoke support structure to the housing structure, the high-voltage insulator further configured to electrically insulate the yoke support structure from the electrically grounded housing structure.

In another aspect of the invention, a computed tomography imaging system comprises: an x-ray source mounted to a gantry, the x-ray source having an anode disk with a first beveled annulus and a second beveled annulus; a first emissive cathode configured to project a first cathode emission onto a first x-ray generating material deposited on the first beveled annulus and thereby produce a first x-ray cone beam emission; a second emissive cathode configured to project a second cathode emission onto a second x-ray generating material deposited on the second beveled annulus and thereby produce a second x-ray cone beam emission; and a detector assembly disposed on the gantry to receive at least a portion of the first x-ray cone beam emission and at least a portion of the second x-ray cone beam emission.

In another aspect of the invention, a method of providing a source of x-rays, comprises: projecting emission from a first emissive cathode onto a first x-ray generating material deposited on a first beveled annulus on an anode disk, the anode disk rotating with respect to a housing structure; and projecting emission from a second emissive cathode onto a second x-ray generating material deposited on a second beveled annulus on the anode disk.

Other systems and/or methods according to the embodiments will become or are apparent to one with skill in the art upon review of the following drawings and detailed description. It is intended that all such additional systems and methods be within the scope of the present invention, and be protected by the accompanying claims.

DETAILED DESCRIPTION OF THE INVENTION

This invention includes a rotating anode with a dual-beveled annulus configuration that provides for two independently-controlled focal spots, one on each annulus. For many representative scanning sequences, this provides for greater flexibility in operation as alternating x-ray source activation can be used to optimize image acquisition. A yoke structure supports electron beam emission cathodes from a single high-voltage insulator in a housing wall. In addition, a high-load capacity straddle-type bearing support arrangement for the rotating anode is able to withstand high gantry rotation speeds.

Figure 1:
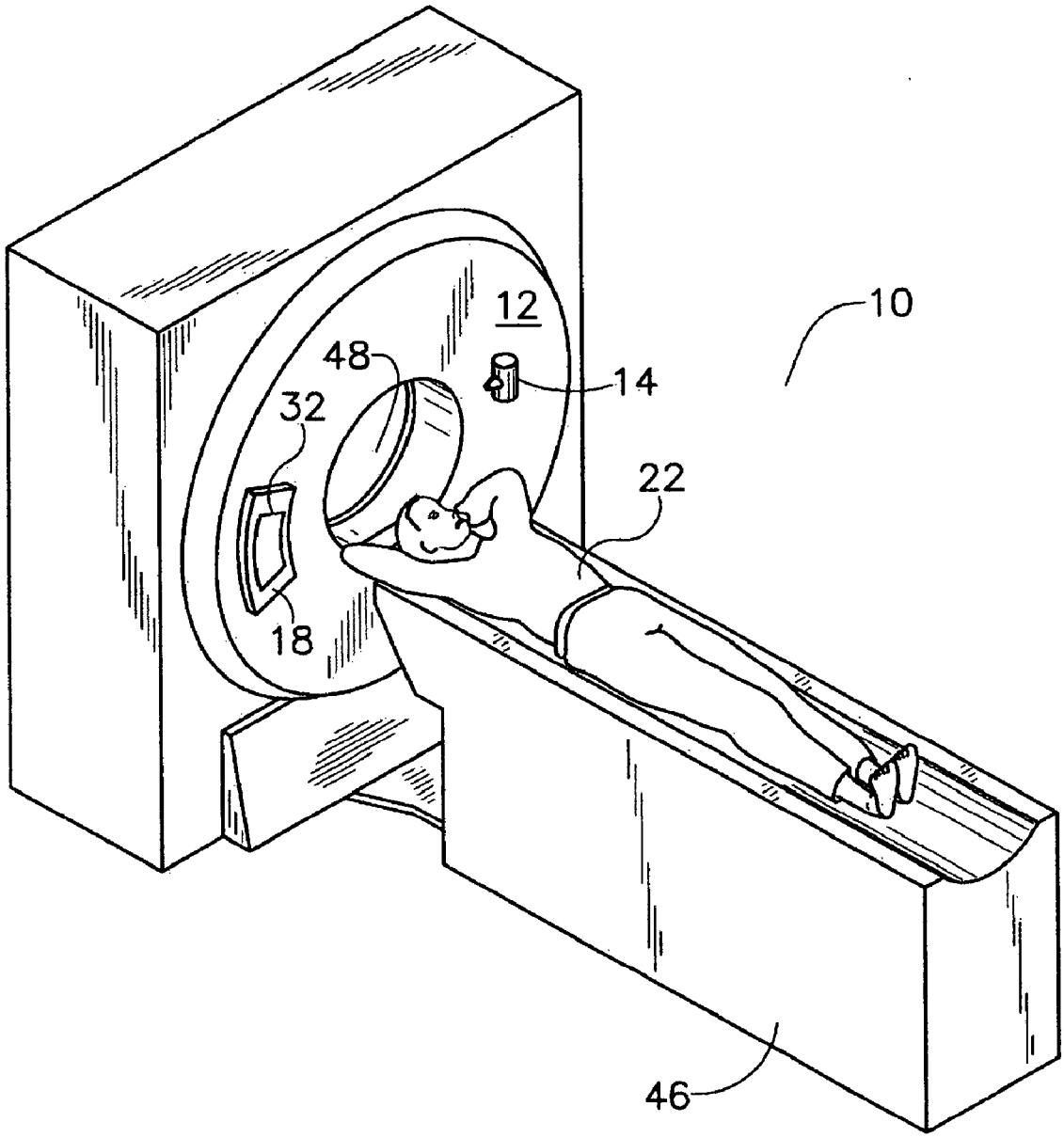
Fig. 1 (Prior Art)
FIG. 1 is an isometric diagrammatical view of a computed tomography imaging system, in accordance with the present art.

There is shown in the isometric diagrammatical illustration of FIG. 1 a "third generation" CT imaging system 10 configured to perform computed tomography imaging by means of photon counting and energy discrimination of x-rays at high flux rates, as is known in the relevant art. The CT imaging system 10 comprises a gantry 12, with a collimator assembly 18, a data acquisition system 32, and an x-ray source 14 disposed on the gantry 12 as shown. A table 46 serves to move all or part of a target, such as an object or a patient 22, through a gantry opening 48 in the gantry 12.

Figure 2:
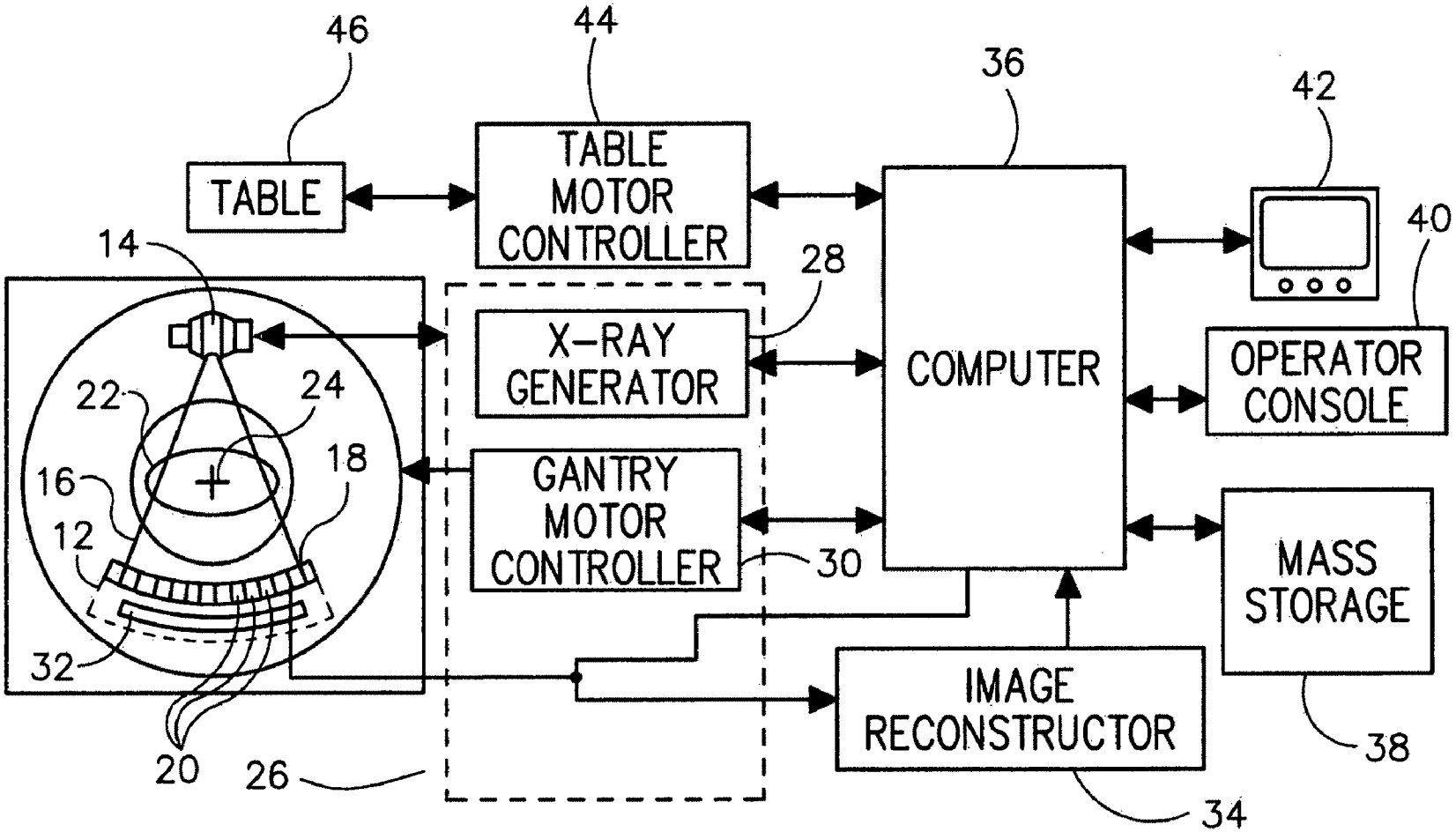
Fig. 2 (Prior Art)
FIG. 2 is a functional block diagram of the computed tomography imaging system of FIG. 1.

Operation of the CT imaging system 10 may be described with reference to the functional block diagram of FIG. 2. The x-ray source 14 projects a beam of x-rays 16 through the patient 22 onto a plurality of detector modules 20 in a detector assembly 12. The detector assembly 12 includes the collimator assembly 18, the detector modules 20, and the data acquisition system 32. In a typical embodiment, the detector assembly 12 may comprise sixty-four rows of pixel elements to enable sixty-four simultaneous "slices" of data to be collected with each rotation of the gantry 12.

The plurality of detector modules 20 sense the x-rays remaining after partial attenuation upon passing through the patient 22, and the data acquisition system 32 converts the data to digital signals for subsequent processing. Each detector module 20 in a conventional system produces an analog electrical signal that represents the intensity of an attenuated x-ray beam after it has passed through the patient 22. During a scan to acquire x-ray projection data, the gantry 12 rotates about a center of rotation 24 along with the x-ray source 14 and the detector assembly 15.

The rotation of the gantry 12 and the operation of the x-ray source 14 are controlled by a control mechanism 26. The control mechanism 26 includes an x-ray generator 28 that provides power and timing signals to the x-ray source 14, and a gantry motor controller 30 that controls the rotational speed and position of the gantry 12. An image reconstruction processor 34 receives sampled and digitized x-ray data from the data acquisition system 32 and performs high speed reconstruction. The reconstructed image is applied as an input to a computer 36 which can also store the image in a mass storage device 38.

The computer 36 also receives commands and scanning parameters input from an operator console 40. An associated display, such as a cathode ray tube display 42, allows an operator to observe the reconstructed image and other data from the computer 36. The commands and scanning parameters are used by the computer 36 to provide control signals and information to the data acquisition system 32, the x-ray generator 28, and the gantry motor controller 30. In addition, the computer 36 operates a table motor controller 44 which controls the motorized table 46.

Figure 3:
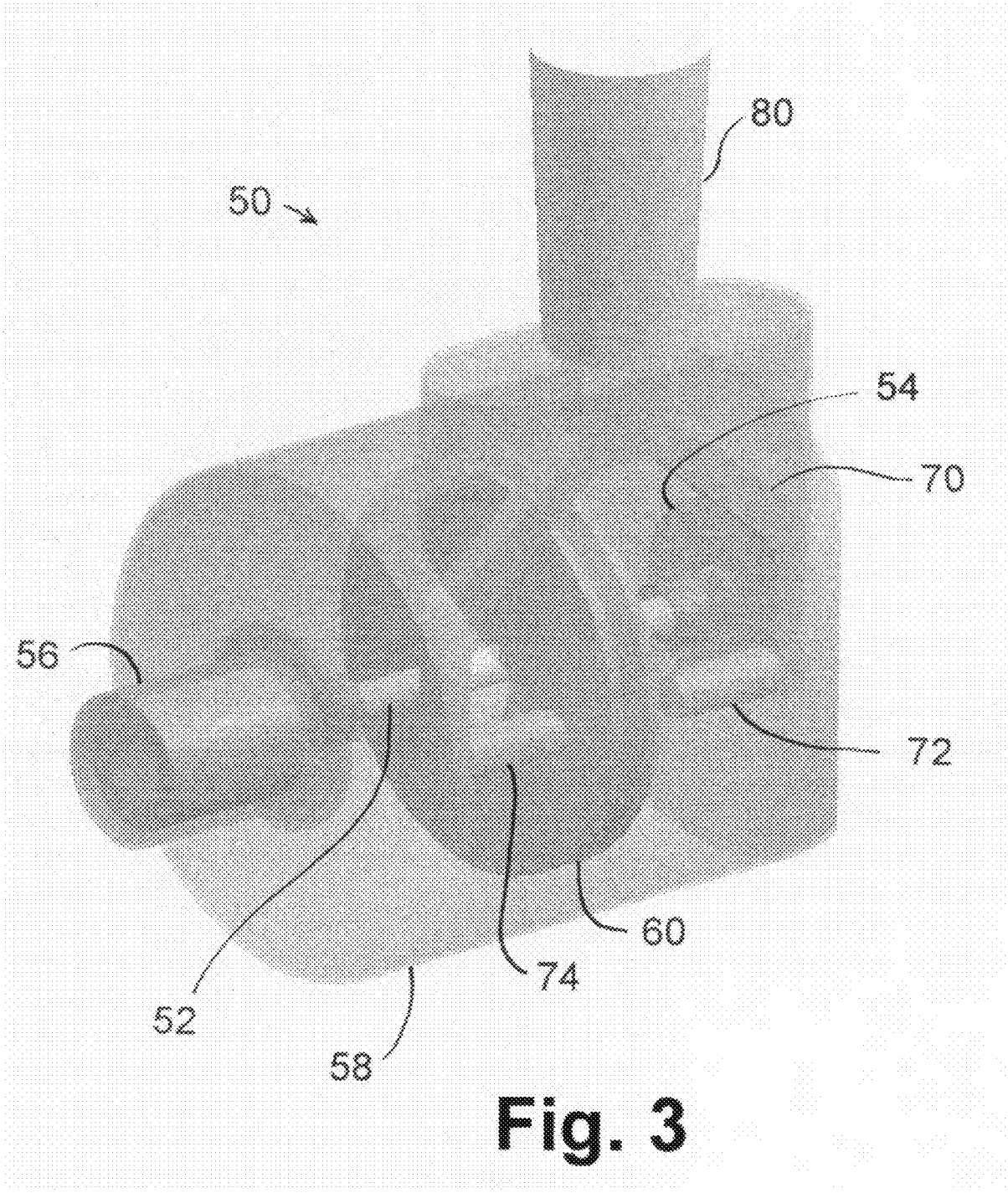
FIG. 3 is an isometric diagrammatical view of an x-ray source including an anode disk and a yoke support, in accordance with aspects of the present technique.

There is shown in FIG. 3 an exemplary embodiment of an x-ray source 50 such as can be used in a CT medical imaging system. The x-ray source 50 comprises an anode disk 60 secured to a support shaft 52 which is rotatably retained in a first bearing 54 and a second bearing 56. Torque may be applied via the support shaft 52 to rotate the anode disk 60 during operation of the x-ray source 50. The first bearing 54 and the second bearing 56 are mounted to a housing 58, which retains a vacuum and provides required mechanical stiffness to support the anode disk 60, particularly when in motion. The housing 58 may be referred to as a "frame" in the relevant art. This configuration, in which the anode disk 60 is substantially equidistant between the first bearing 54 and the second bearing 56, forms a "straddle bearing" structure with the anode disk 60 and the shaft 52. This straddle bearing configuration ensures an approximately equal load sharing between the first bearing 54 and the second bearing 56, and provides mechanical integrity to the x-ray source 50 for withstanding rapid gantry rotation at high loads.

The x-ray source 50 further includes a first emissive cathode 72 and a second emissive cathode 74 mounted to a yoke support 70 such that emissions from the first emissive cathode 72 and the second emissive cathode 74 are projected onto the anode disk 60, as described in greater detail below. The yoke support 70 is retained in a predetermined position by a high-voltage insulator 80 which is secured to the housing 58. The high-voltage insulator 80 also serves to electrically insulate the yoke support 70 from the housing 58, which may be retained at ground potential. In an exemplary embodiment, the x-ray source 50 operates with the anode disk 60 at ground potential and the first emissive cathode 72 and the second emissive cathode 74 maintained at large relative potentials, such as −120 kV for example. In an alternative exemplary embodiment, the anode disk 60 can be maintained at +60 kV with the emissive cathodes 72 and 74 maintained at −60 kV.

Figure 4:
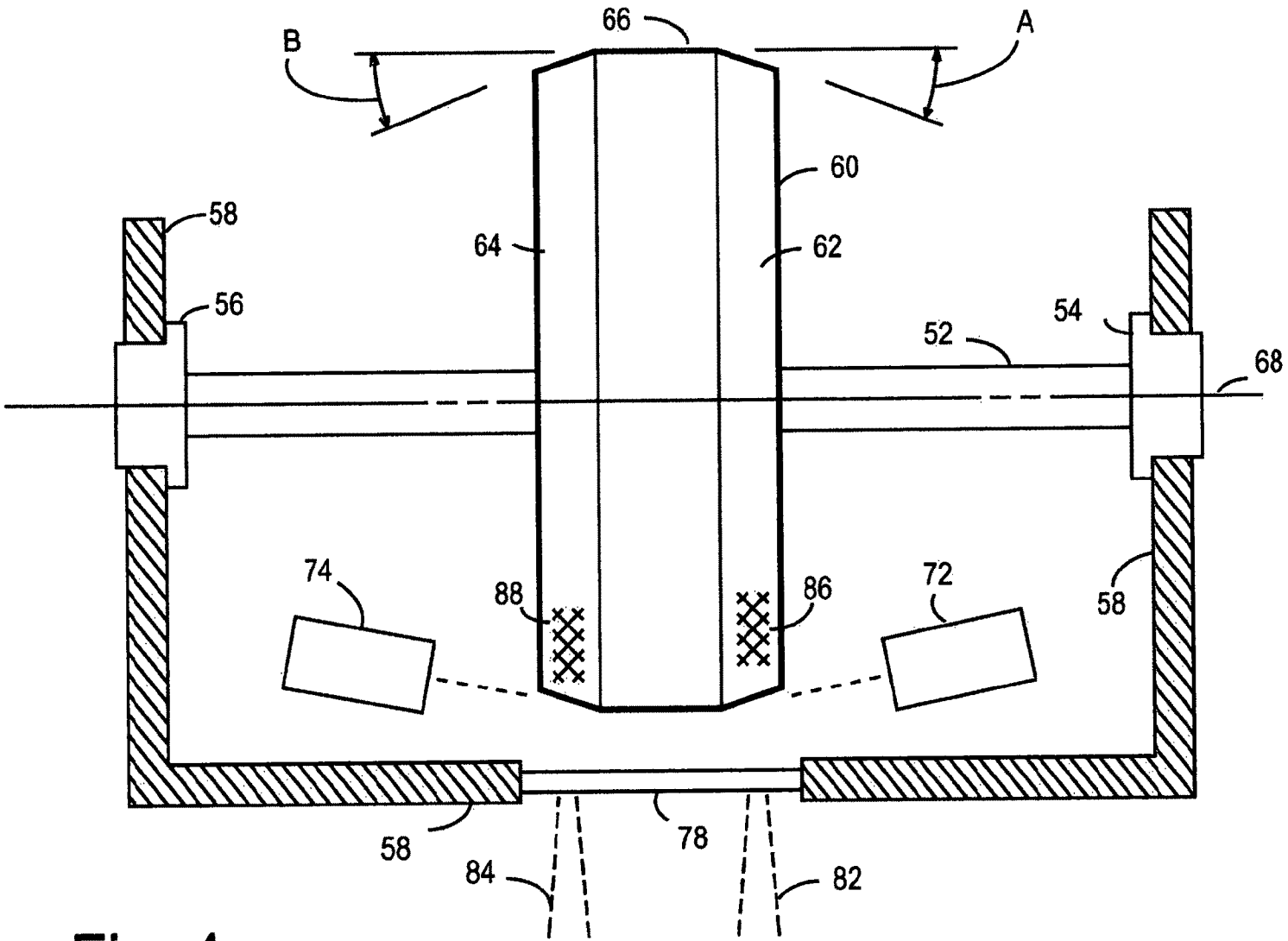
FIG. 4 is a detail diagrammatical view of the anode disk of FIG. 3.

As best seen in the diagrammatical illustration of FIG. 4, the anode disk 60 and the support shaft 52 rotate about a rotational axis 68 which passes through the first bearing 54 and the second bearing 56. The yoke support 70 is not shown, for clarity of illustration. As the anode disk 60 rotates, emission from the first emissive cathode 72 is projected onto a film or layer of a first x-ray generating material 86 that has been deposited on a first beveled annulus 62 of the anode disk 60. The first x-ray generating material 86 is deposited on, or otherwise disposed on, essentially the entire circumferential length of the first beveled annulus 62, but only a portion of the first x-ray generating material 86 is shown for clarity of illustration. The first beveled annulus 62 forms a truncated conical surface having a predefined first bevel angle of from five to ten degrees, here denoted as angle 'A', with respect to a periphery surface 66 of the anode disk 60. Similarly, emission from the second emissive cathode 74 is projected onto a film or layer of a second x-ray generating material 88 deposited on a second beveled annulus 64 having a second bevel angle of from five to ten degrees, here denoted as angle 'B'. In an exemplary embodiment, the angles A and B are approximately seven degrees, and may be equal angles.

The first x-ray generating material 86 and the second x-ray generating material 88 preferably comprise materials having high atomic numbers, relatively high melting points, relatively high thermal conductivities, and relatively high temperature strength such as, for example, tungsten or a tungsten-rhenium alloy. It should also be understood that first x-ray generating material 86 and the second x-ray generating material 88 may comprise the same material. The interaction of the first emissive cathode 72 emission with the first x-ray generating material 86 and the interaction of the second emissive cathode 74 emission with the second x-ray generating material 88 generate respective x-ray cone beam emissions 82 and 84 on both sides of the anode disk 60. These x-ray cone beam emissions 82 and 84 pass through a housing window 78 for subsequent application in a CT imaging system, where the housing window material is selected so as having a relatively low attenuation for x-ray radiation of the wavelengths generated at the first x-ray generating material 86 and at the second x-ray generating material 88.

Figure 5:
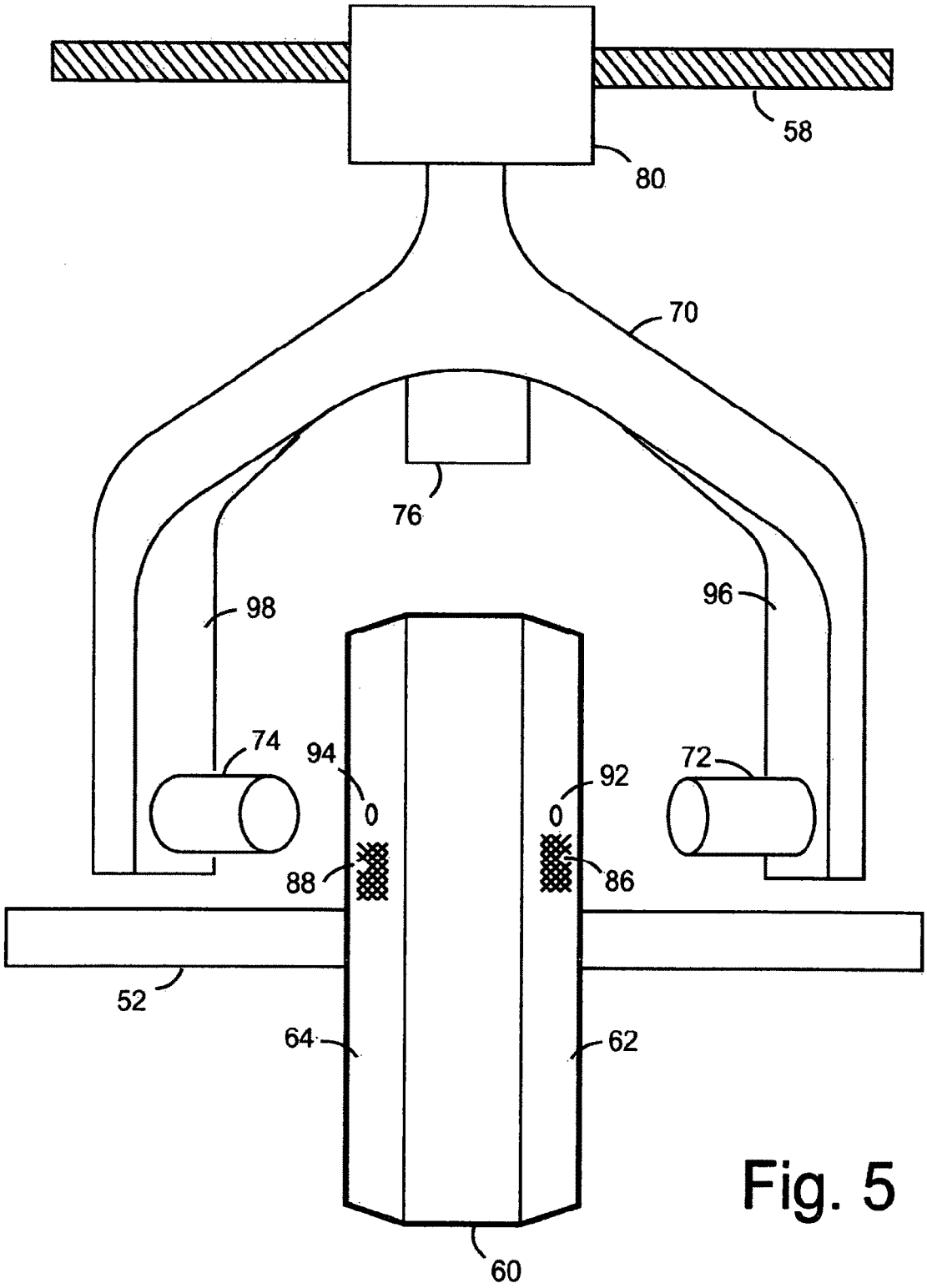
FIG. 5 is a detail diagrammatical view of the yoke support of FIG. 3.

FIG. 5 provides a diagrammatical illustration of the relative positions of the yoke support 70 and the anode disk 60 during operation of the x-ray source 50. As the anode disk 60 is rotated via the support shaft 52, the first emissive cathode 72 projects an emission, such as an electron beam emission, to form a first focal spot 92 on the first x-ray generating material 86. The second emissive cathode 74 projects an emission, such as an electron beam emission, to form a second focal spot 94 on the second x-ray generating material 88. The first emissive cathode 72 is mounted to a first leg 96 of the yoke support 70, and the second emissive cathode 74 is mounted to a second leg 98 of the yoke support 70 with the anode disk 60 disposed between the first leg 96 and the second leg 98, as shown. The yoke support 70 is shown in a slightly distorted configuration, for clarity of illustration, to show attachment of the first emissive cathode 72 to the first leg 96 and attachment of the second emissive cathode 74 to the second leg 98. The first leg 96 and the second leg 98 function to retain the first emissive cathode 72 and the second emissive cathode 74, respectively, in fixed position and orientation with respect to the first beveled annulus 62 and the second beveled annulus 64 so as to direct the x-ray cone beam emissions 82 and 84 through the housing window 78 (shown in FIG. 4).

Advantageously, the yoke support 70 is configured to accommodate and mechanically couple to a backscatter collector 76 which can be positioned between the first leg 96 and the second leg 98, as shown in FIG. 5. The backscatter collector 76 functions to collect backscattered electrons from the first x-ray generating material 86 and the second x-ray generating material 88. In an exemplary embodiment, the yoke support includes internal channels (not shown) sized and configured to route control and power electrical conductors through the high-voltage insulator 80 to the first emissive cathode 72 and the second emissive cathode 74.

In one aspect of the present invention, the relative axial separation and the cone angle extent (i.e., whether overlapping or not overlapping) of the X-ray cone beams emissions 82 and 84 can be determined from the geometrical configuration of the anode disk and the relative positions of the emissive cathodes 72 and 74. Accordingly, the degree of gap or overlap can be optimized as may be specified by image reconstruction requirements. The emissive cathodes 72 and 74 can be operated independently of one another by an x-ray generator (not shown) similar to the x-ray generator 28 shown in FIG. 2, such that: (i) individual cathode emissions can alternate without overlapping, (ii) individual cathode emissions can occur simultaneously, or (iii) individual cathode emissions can partially overlap in time. The combination of anode disk geometry and cathode timing may be specified so as to optimize CT image acquisition while minimizing heat buildup in the x-ray source 50.

Figure 6:
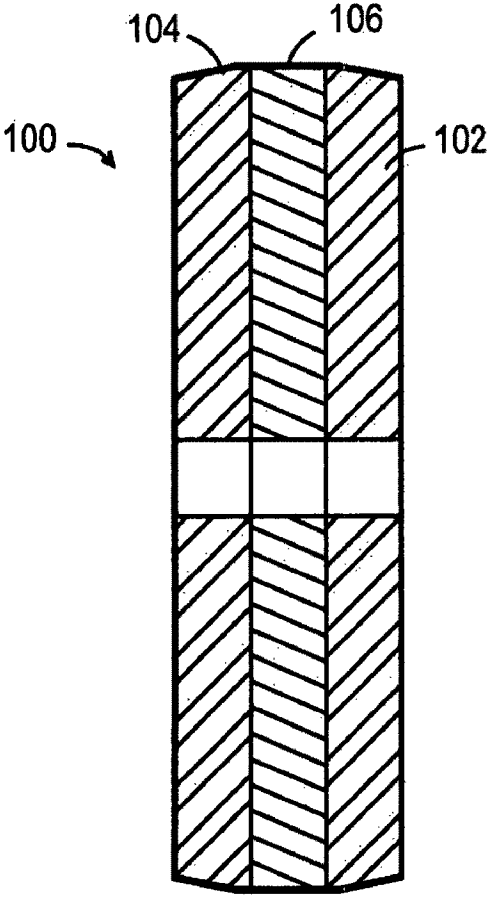
FIG. 6 is a cross sectional diagrammatical view of an exemplary embodiment of the anode disk of FIG. 4 showing a thermal-absorption layer disposed between anode plates.

As best shown in the cross sectional diagrammatical view of FIG. 6, an exemplary embodiment of an anode disk 100 may comprise a thermal-absorption layer 106 disposed between a first anode plate 102 and a second anode plate 104. The anode plates 102 and 104 are fabricated from a material with high mechanical strength and creep resistance at elevated temperatures. The thermal-absorption layer 106 functions to draw thermal energy from the anode plates and is, accordingly, fabricated from a material having a higher thermal capacitance than the anode material. In the embodiment shown, the anode plates 102 and 104 are fabricated from a high-strength molybdenum alloy, and the thermal-absorption layer 106 is fabricated from graphite.

Figure 7:
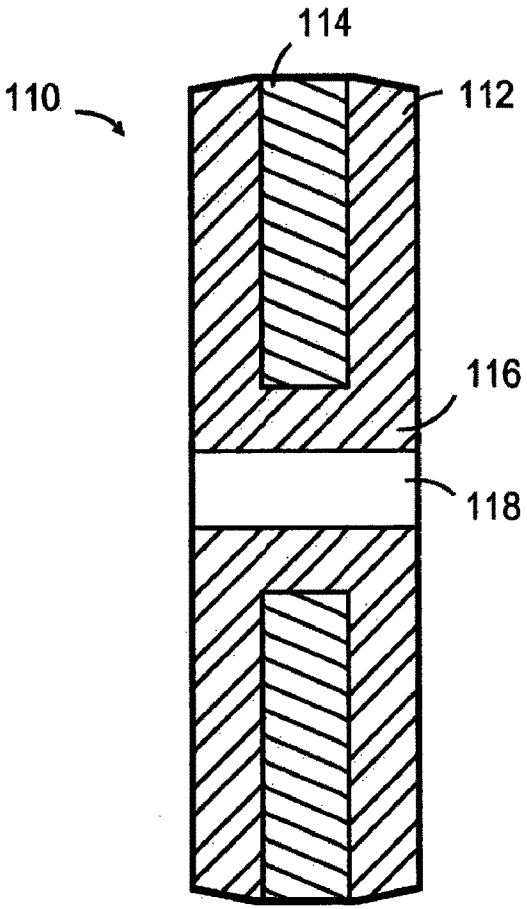
FIG. 7 is a cross sectional diagrammatical view of an exemplary embodiment of the anode disk of FIG. 4 showing a thermal-absorption annulus disposed in an anode plate.

In another exemplary embodiment, shown in the cross sectional diagrammatical view of FIG. 7, an anode disk 110 may comprise a thermal-absorption annulus 114 of lightweight, high thermal capacitance material retained in an anode plate 112 fabricated from a material with high mechanical strength and creep resistance at elevated temperatures. The anode plate 112 is configured as a metal hub 116 with a through hole 118 sized to accommodate the support shaft 52, described above.

Figure 9:
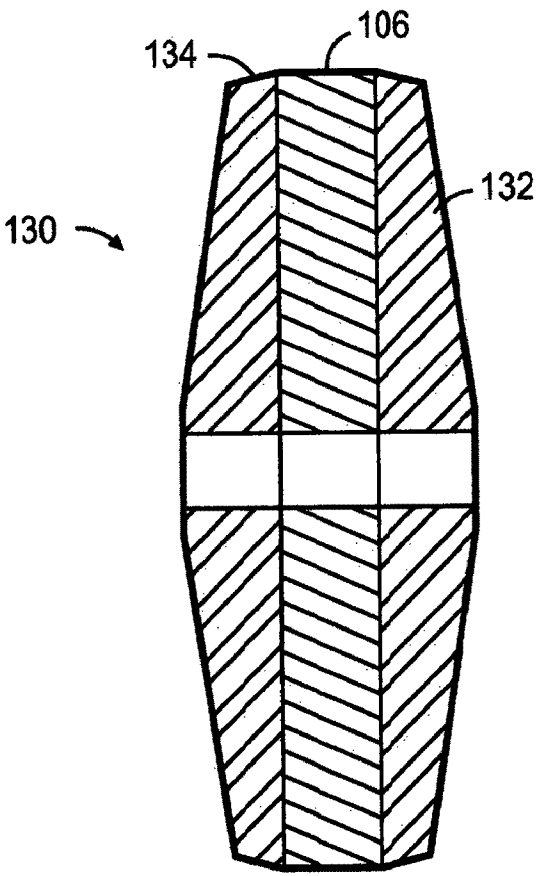
FIG. 9 is a cross sectional diagrammatical view of an exemplary embodiment of the anode disk of FIG. 4 showing a thermal-absorption layer disposed between constant-stress anode plates.
Figure 8:
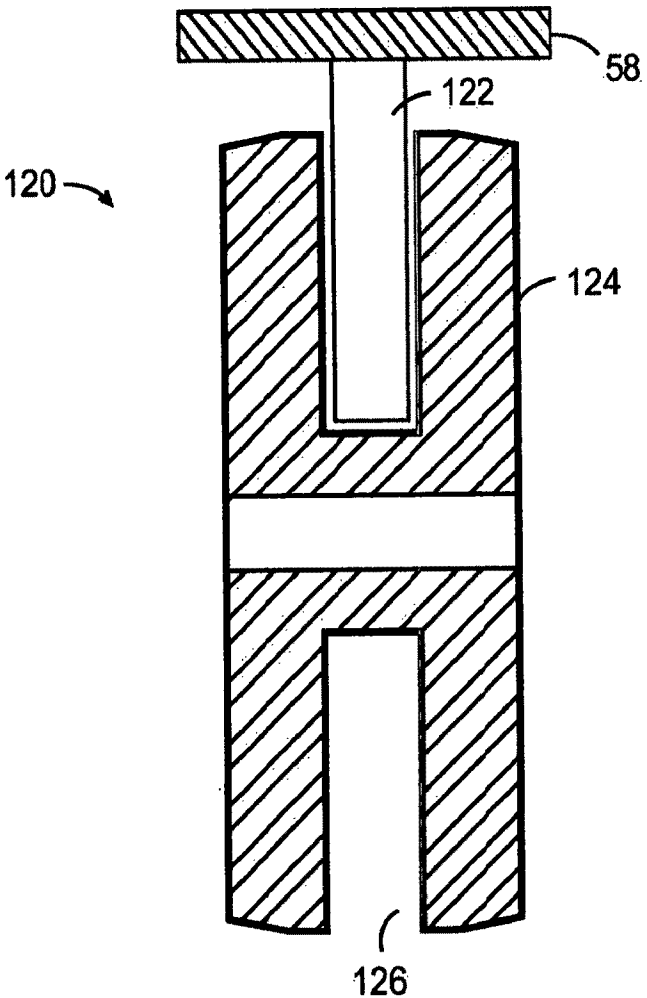
FIG. 8 is a cross sectional diagrammatical view of an exemplary embodiment of the anode disk of FIG. 4 showing an anode plate with a thermal radiation receptor in an annular plate channel.

In yet another exemplary embodiment, shown in the cross sectional diagrammatical view of FIG. 8, an anode disk 120 may comprise an anode plate 124 with a thermal radiation receptor 122 inserted into an annular plate channel 126 in the anode plate 124. As this configuration is a relatively inefficient method of removing excess thermal energy from the anode plate 124, it may be used in an x-ray source having a relatively low continuous power requirement. In still another exemplary embodiment, shown in the cross sectional diagrammatical view of FIG. 9, an anode disk 130 may comprise the thermal-absorption layer 106 disposed between a first constant-stress anode plate 132 and a second constant-stress anode plate 134.

While the invention is described with reference to exemplary embodiments, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling with the scope of the intended claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray source comprising:

an anode disk including a first beveled annulus and a second beveled annulus at a periphery of said anode disk, said anode disk secured to a housing structure via a support shaft;

a first cathode mechanically coupled to a yoke support structure, said yoke support structure configured to project emissions from said first cathode onto a first x-ray generating material deposited on said first beveled annulus;

a second cathode mechanically coupled to said yoke support structure, said yoke support structure further configured to project emissions from said second cathode onto a second x-ray generating material deposited on said second beveled annulus; and a high-voltage insulator configured to mechanically attach said yoke support structure to said housing structure, said high-voltage insulator further configured to electrically insulate said yoke support structure from said housing structure.

2. The x-ray source of claim 1 wherein said anode disk comprises a thermal-absorption layer disposed between a first anode plate and a second anode plate.

3. The x-ray source of claim 2 wherein said thermal-absorption layer comprises a material having a higher thermal capacitance than said first anode plate.

4. The x-ray source of claim 2 wherein said thermal-absorption layer comprises graphite.

5. The x-ray source of claim 2 wherein said first anode plate comprises a layer of either tungsten or a tungsten-rhenium alloy disposed on a beveled molybdenum annulus.

6. The x-ray source of claim 2 wherein said anode disk comprises a thermal-absorption annulus disposed in an anode plate having a metal hub.

7. The x-ray source of claim 1 wherein said anode disk comprises a thermal-absorption layer disposed between a first constant-stress anode plate and a second constant-stress anode plate.

8. The x-ray source of claim 1 further comprising a thermal radiation receptor inserted into an annular plate channel in said anode disk.

9. The x-ray source of claim 1 wherein at least a portion of said first beveled annulus is disposed within eight centimeters of at least a portion of said second beveled annulus.

10. The x-ray source of claim 1 further comprising a first bearing and a second bearing attached to said housing structure, wherein said support shaft is rotatably retained in said first bearing and said second bearing.

11. The x-ray source of claim 10 wherein said anode disk is disposed substantially equidistant between said first bearing and said second bearing.

12. The x-ray source of claim 1 wherein said first beveled annulus comprises a bevel angle of approximately five to ten degrees.

13. A computed tomography imaging system comprising:

an x-ray source mounted to a gantry, said x-ray source having an anode disk with a first beveled annulus and a second beveled annulus;

a first emissive cathode configured to project a first cathode emission onto a first x-ray generating material deposited on said first beveled annulus and thereby produce a first x-ray cone beam emission;

a second emissive cathode configured to project a second cathode emission onto a second x-ray generating material deposited on said second beveled annulus and thereby produce a second x-ray cone beam emission;

a yoke support structure to which the first emissive cathode and the second emissive cathode are respectively mechanically coupled; and a detector assembly disposed on said gantry to receive at least a portion of said first x-ray cone beam emission and at least a portion of said second x-ray cone beam emission.

14. The computed tomography imaging system of claim 13 further comprising an x-ray generator for operating said first and second emissive cathodes independently of one another.

15. A method of providing a source of x-rays, said method comprising the steps of:

projecting emission from a first emissive cathode onto a first x-ray generating material deposited on a first beveled annulus on an anode disk, said anode disk rotating with respect to a housing structure; and projecting emission from a second emissive cathode onto a second x-ray generating material deposited on a second beveled annulus on said anode disk wherein said first emissive cathode is mounted to a first leg of a yoke support structure and said second emissive cathode is mounted to a second leg of said yoke support structure, such that said anode disk is disposed between said first leg and said second leg.

16. The method of claim 15 wherein said step of projecting emission from said first emissive cathode is performed independently of said step of projecting emission from said second emissive cathode.

17. The method of claim 15 further comprising the step of applying torque to a support shaft so as to produce rotation of said anode disk.

18. The method of claim 15 wherein said step of projecting emission from said first emissive cathode alternates with said step of projecting emission from said second emissive cathode such that respective cathode emissions alternate without overlapping.

19. The method of claim 15 wherein said step of projecting emission from said first emissive cathode alternates with said step of projecting emission from said second emissive cathode such that respective cathode emissions partially overlap in time.

* * * * *